US010548208B2

(12) United States Patent
Yuasa et al.

(10) Patent No.: US 10,548,208 B2
(45) Date of Patent: Jan. 28, 2020

(54) X-RAY DEVICE

(71) Applicant: Shimadzu Corporation, Kyoto (JP)

(72) Inventors: Takuya Yuasa, Kyoto (JP); Norimasa Hishida, Kyoto (JP); Makoto Katoh, Kyoto (JP)

(73) Assignee: Shimadzu Corporation, Nishinokyo-Kuwabaracho, Nakagyo-ku, Kyoto-shi, Kyoto (JP)

( * ) Notice: Subject to any disclaimer, the term of this patent is extended or adjusted under 35 U.S.C. 154(b) by 209 days.

(21) Appl. No.: 15/523,598

(22) PCT Filed: Oct. 30, 2014

(86) PCT No.: PCT/JP2014/078987
§ 371 (c)(1),
(2) Date: May 1, 2017

(87) PCT Pub. No.: WO2016/067432
PCT Pub. Date: May 6, 2016

(65) Prior Publication Data

US 2017/0318653 A1 Nov. 2, 2017

(51) Int. Cl.
*H05G 1/58* (2006.01)
*H05G 1/56* (2006.01)

(52) U.S. Cl.
CPC ..... *H05G 1/58* (2013.01); *H05G 1/56* (2013.01)

(58) Field of Classification Search
CPC .. H05G 1/56; H05G 1/58; H05G 1/10; H05G 1/32; A61B 6/56
See application file for complete search history.

(56) References Cited

U.S. PATENT DOCUMENTS 4,454,606 A * 6/1984 Relihan ..... H05G 1/26 378/108
2002/0131553 A1* 9/2002 Tsuchino ..... A61B 6/00 378/118
2007/0230657 A1* 10/2007 Garms ..... G01N 23/046 378/57

FOREIGN PATENT DOCUMENTS

CN 203054488 U 7/2013
JP 2012-034791 2/2012

OTHER PUBLICATIONS

Notification of Reasons for Refusal dated Apr. 3, 2018 of corresponding Chinese Patent application No. 201480083004.9.

* cited by examiner

*Primary Examiner* — Chih-Cheng Kao
(74) *Attorney, Agent, or Firm* — Muir Patent Law, PLLC

(57) ABSTRACT

An X-ray device may comprise a timer for monitoring a nonoperation time, such as a time from a previous signal input to a control circuit to the next input signal. When the timer detects that the nonoperation time has exceeded a preset time, the control circuit controls the contactors and so as to turn off the contactors. The standby power of the X-ray device when the frequency of use during the nonoperation time is low can be reduced. Further, when the next signal is input to the control circuit, the control circuit controls the contactors so as to close the contactors, thereby restoring power supply. Therefore, when the next signal is input to the control circuit, the X-ray device is turned to a usable state.

8 Claims, 4 Drawing Sheets

X-RAY DEVICE

TECHNICAL FIELD

The present invention relates to an X-ray device provided with an X-ray irradiation means for irradiating an X-ray.

BACKGROUND TECHNIQUE

A conventional X-ray device is provided with an X-ray tube for irradiating an X-ray and a high voltage generator for supplying a high voltage to the X-ray tube, and is further provided with a power supply means for supplying power to these constituent elements.

However, if power is continuously supplied to the constituent elements even when X-ray photographing is not performed, there is a problem that, for example, standby power due to, e.g., a filament current of an X-ray tube is consumed.

In this regard, Patent Document 1 discloses an invention in which a connection between a power supply and an X-ray tube is disconnected in order to cut off a filament current in a standby mode.

PRIOR ART

Patent Document

Patent Document 1: Japanese Unexamined Patent Application Publication No. 2012-34791

SUMMARY OF THE INVENTION

Problems to be Solved by the Invention

In order to cut off the power supply to the X-ray tube and/or the high voltage generator, a large capacity contactor is generally used. However, since a large capacity contactor itself consumes large standby power, a sufficient energy saving effect has not been attained.

The present invention was made in view of such circumstances, and aims to provide an X-ray device in which standby power is further reduced.

Means for Solving the Problems

In order to attain such an object, the present invention has the following configuration. That is, an X-ray device according to the present invention is an X-ray device provided with X-ray irradiation means for irradiating an X-ray. The X-ray device includes an electromagnetic switch configured to open/close a power supply line to the X-ray irradiation means, a control circuit configured to control power supply to the electromagnetic switch and opening/closing of the electromagnetic switch, and judging means configured to judge whether or not the X-ray irradiation means should be set to a standby mode. The control circuit reduces or cuts off power supply to the electromagnetic switch and releases the electromagnetic switch while the judging means is judging that it should be set to the standby mode.

According to the X-ray device of the present invention, during the aforementioned nonoperation time, the power supply, not only to the X-ray irradiation means but also to the electromagnetic switch, is reduced or cut off. Therefore, it is possible to further reduce the standby power in the standby mode. Particularly, in cases where the X-ray irradiation means is configured by an X-ray tube, or in cases where an electromagnetic switch capable of cutting off electric power supplied to the X-ray irradiation means such as a high voltage generator (X-ray generation mechanism) is used, the capacity is large and therefore the standby power is also large. Even in such cases, the standby power can be appropriately suppressed.

Particularly, in cases where X-ray irradiation means is configured by the X-ray tube, the X-ray tube requires preliminary heating before photographing. Therefore, when it is attempted to resume photographing from a state in which the supply of electric power is suspended, it takes time to perform preliminary heating.

In this regard, if the judging means of the X-ray device according to the present invention is configured to judge that it should be set to a standby mode when a nonoperation time set by a user exceeds a threshold, it is possible to prevent deterioration of the operability during photographing and the standby power when not in use can be appropriately reduced.

Further, it may be configured such that the electromagnetic switch has a structure capable of closing only while the predetermined electric power is being supplied, and that the control circuit turns off an electromagnetic switch by reducing or cutting off the power supply to the electromagnetic switch.

Further, it may be configured such that the electromagnetic switch includes a power supply terminal for supplying power and an opening/closing terminal for supplying an opening/closing signal and that the control circuit reduces or cuts off the power supply to the electromagnetic switch by reducing or cutting off power to the power supply terminal and controls the opening/closing of the electromagnetic switch by controlling a signal to the opening/closing signal terminal.

Effects of the Invention

According to the X-ray device of the present invention, during the aforementioned nonoperation time, the power supply not only to the X-ray irradiation means but also to the electromagnetic switch is reduced or cut off. Therefore, it is possible to further reduce the standby power in the standby mode. Particularly, in cases where the X-ray irradiation means is configured by an X-ray tube, or in cases where an electromagnetic switch capable of cutting off electric power supplied to X-ray irradiation means such as a high voltage generator (X-ray generation mechanism) is used, the capacity is large and therefore the standby power is also large. Even in such cases, the standby power can be appropriately suppressed.

EMBODIMENTS

Figure 1:
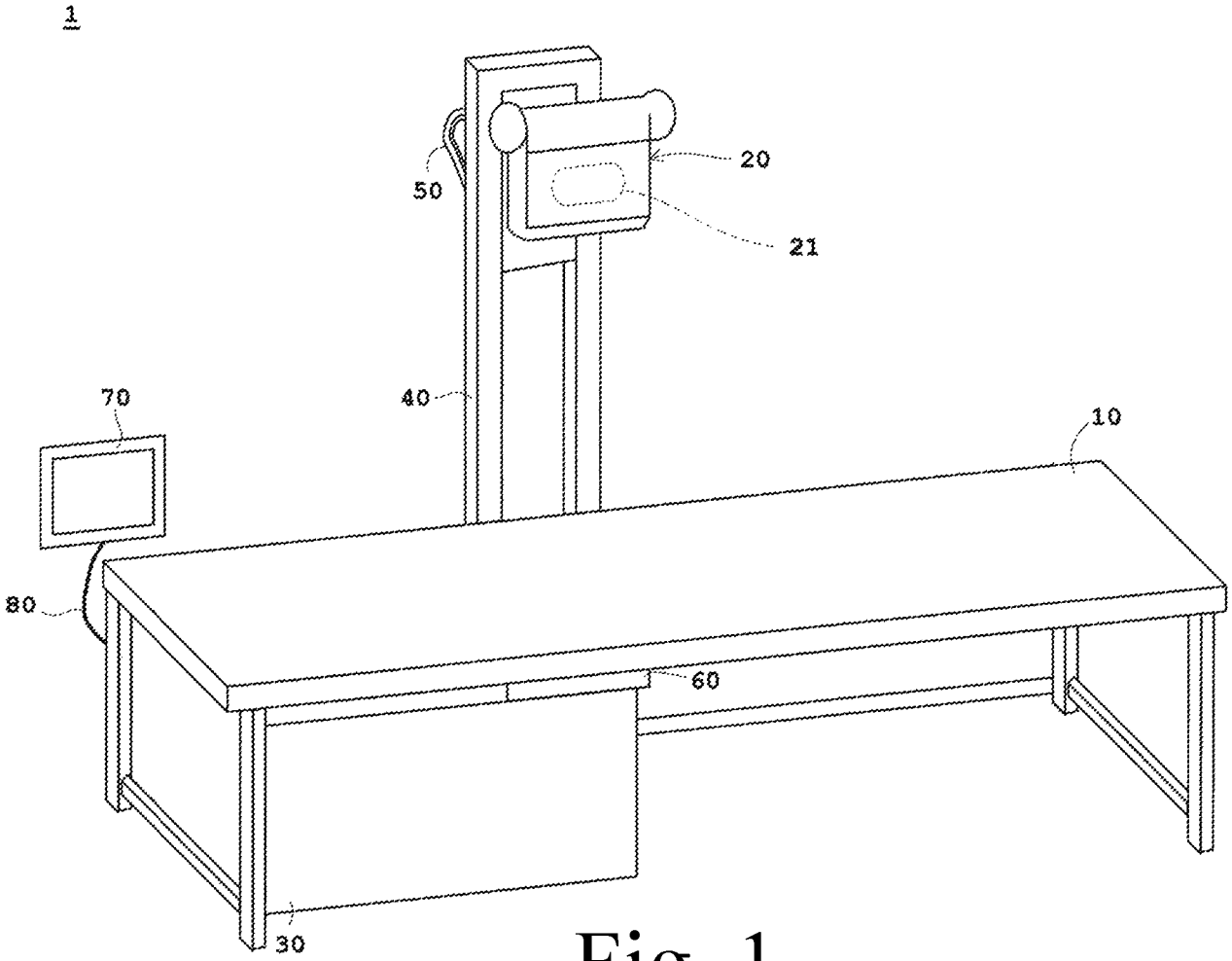
FIG. 1 is a schematic perspective view of an X-ray device according to an embodiment.
Figure 2:
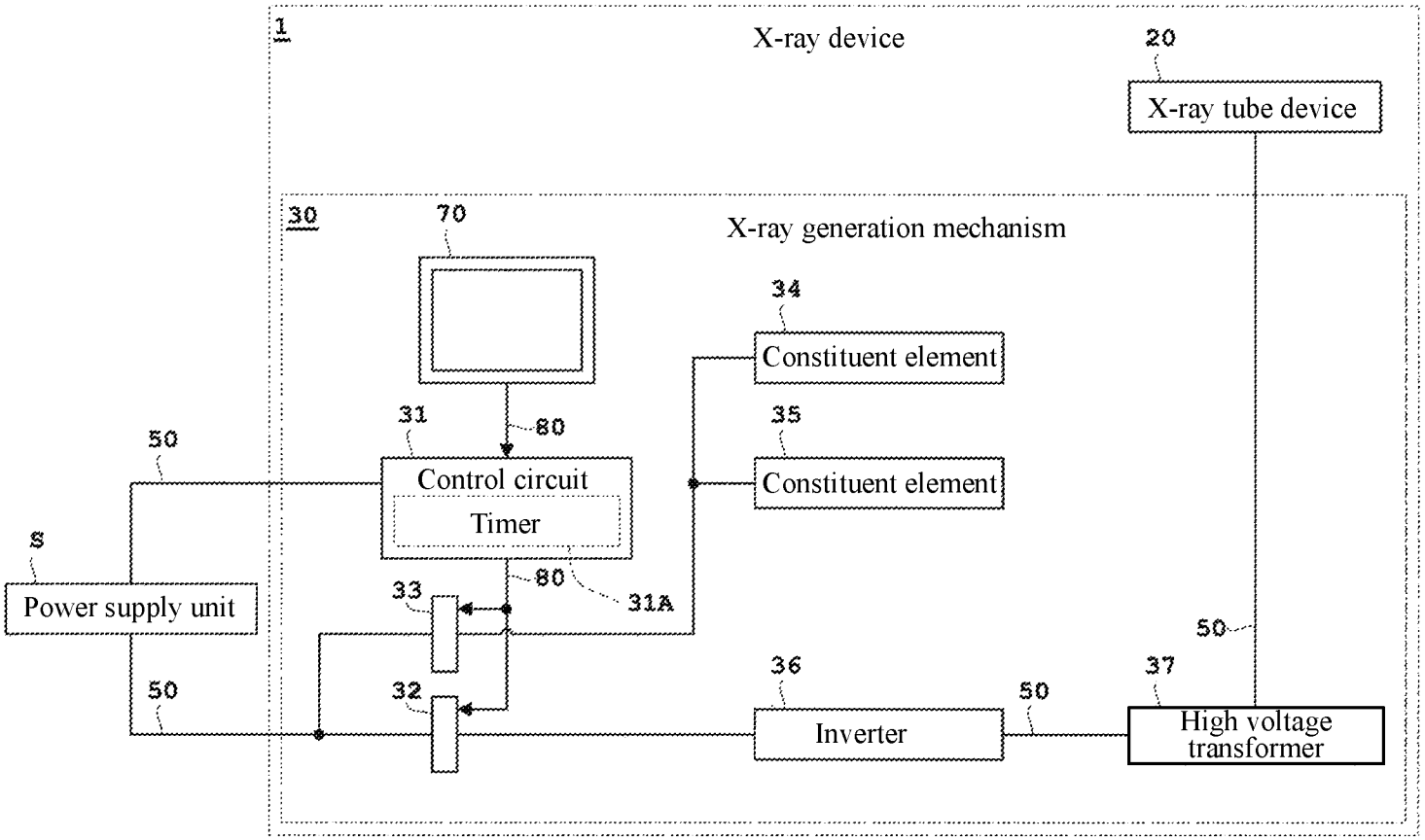
FIG. 2 is a block diagram of the X-ray device according to the embodiment.

Hereinafter, embodiments of the present invention will be described with reference to the drawings. FIG. 1 is a schematic perspective view of an X-ray device according to an embodiment, and FIG. 2 is a block diagram of the X-ray device according to the embodiment.

As shown in FIG. 1, the X-ray device 1 according to this embodiment is provided with a top board 10 on which a subject (not shown) is arranged, an X-ray tube device 20 having an X-ray tube 21 for irradiating an X-ray to the subject, and an X-ray generation mechanism 30. In addition to the above, in FIG. 1, the X-ray device 1 is further provided with a support post 40 that supports the X-ray tube device 20, a power cable 50 configuring a power supply line installed along the support post 40, and a cassette 60 configured to load an X-ray film (not illustrated) and a flat panel type X-ray detector (FPD: Flat Panel Detector) (not illustrated). The X-ray tube 21 corresponds to X-ray irradiation means according to the present invention, and the power cable 50 corresponds to a power supply line according to the present invention.

The X-ray tube device 20 is movable in the vertical direction along the support post 40, and the support post 40 is movable in the horizontal direction. By configuring the X-ray tube device 20 so that it can move up and down in the vertical direction along the support post 40, it is possible to move the X-ray tube device 20 up and down to a desired position. By configuring the support post 40 so that it can move in the horizontal direction, it is possible to move the X-ray tube device 20 supported by the support post 40 in the horizontal direction to a desired position.

The power cable 50 electrically connects the X-ray tube device 20 and the X-ray generation mechanism 30. In this embodiment, the X-ray device 1 is further provided with an operation unit 70 and a communication cable 80 as shown in FIG. 1. The X-ray generation mechanism 30 and the operation unit 70 are electrically connected by the communication cable 80.

As shown in FIG. 2, the X-ray generation mechanism 30 is provided with a control circuit 31, a plurality of contactors (two contactors 32 and 33 in FIG. 2), a plurality of constituent elements (two constituent elements 34 and 35 in FIG. 2), an inverter 36, and a high voltage transformer 37. A power supply unit S is provided outside the X-ray device 1. The power supply unit S and the control circuit 31 are electrically connected by the power cable 50. The power supply unit S and the inverter 36 are electrically connected by the power cable 50 via the contactor 32. The power supply unit S and two constituent elements 34 and 35 are electrically connected via the contactor 33. The control circuit 31 corresponds to a control circuit according to the present invention, and the contactor 32 and 33 corresponds to electromagnetic switch according to the present invention.

Further, the inverter 36 and the high voltage transformer 37 are electrically connected by the power cable 50, and the high voltage transformer 37 and the X-ray tube device 20 are electrically connected by the power cable 50. By electrically connecting them as described above, when the contactor 32 is in a closed or ON state, electric power is supplied from the power supply unit S to the inverter 36, the high voltage transformer 37, and the X-ray tube device 20 in this order. Similarly, when the contactor 33 is in a closed or ON state, electric power is supplied from the power supply unit S to the respective constituent elements 34 and 35.

The X-ray tube device 20 has an X-ray tube 21 (see FIG. 1) as described above. Other than the X-ray tube 21, in order to prevent from becoming a high temperature due to heat generation by the X-ray generation of the X-ray tube 21, the X-ray tube device 20 is provided with, e.g., a circulation path (not illustrated) for circulating a refrigerant (for example, insulating oil) to the X-ray tube 21 and a cooler (not illustrated) for cooling the refrigerant.

The control circuit 31 is provided with a timer 31A for monitoring a time. In this embodiment, the timer 31A monitors a nonoperation time, which is described later, and judges that it should be set to a standby mode when the nonoperation time has exceeded a threshold (preset time). As described above, the control circuit 31 and the operation unit 70 are electrically connected by the communication cable 80, and a signal from the operation unit 70 is input to the control circuit 31 via the communication cable 80. Other than this, a computer (not illustrated) and an image processing apparatus (not illustrated) provided outside the X-ray device 1 are electrically connected to the control circuit 31 via a communication cable 80. The signals from the computer and image processing apparatus are input to the control circuit 31. The control circuit 31 and the contactors 32 and 33 are electrically connected by the communication cable 80. In FIGS. 1 and 2, the operation unit 70 is provided in the X-ray device 1, but the operation unit may be provided outside the X-ray device 1. The timer 31A corresponds to judging means according to the present invention.

Figure 4:
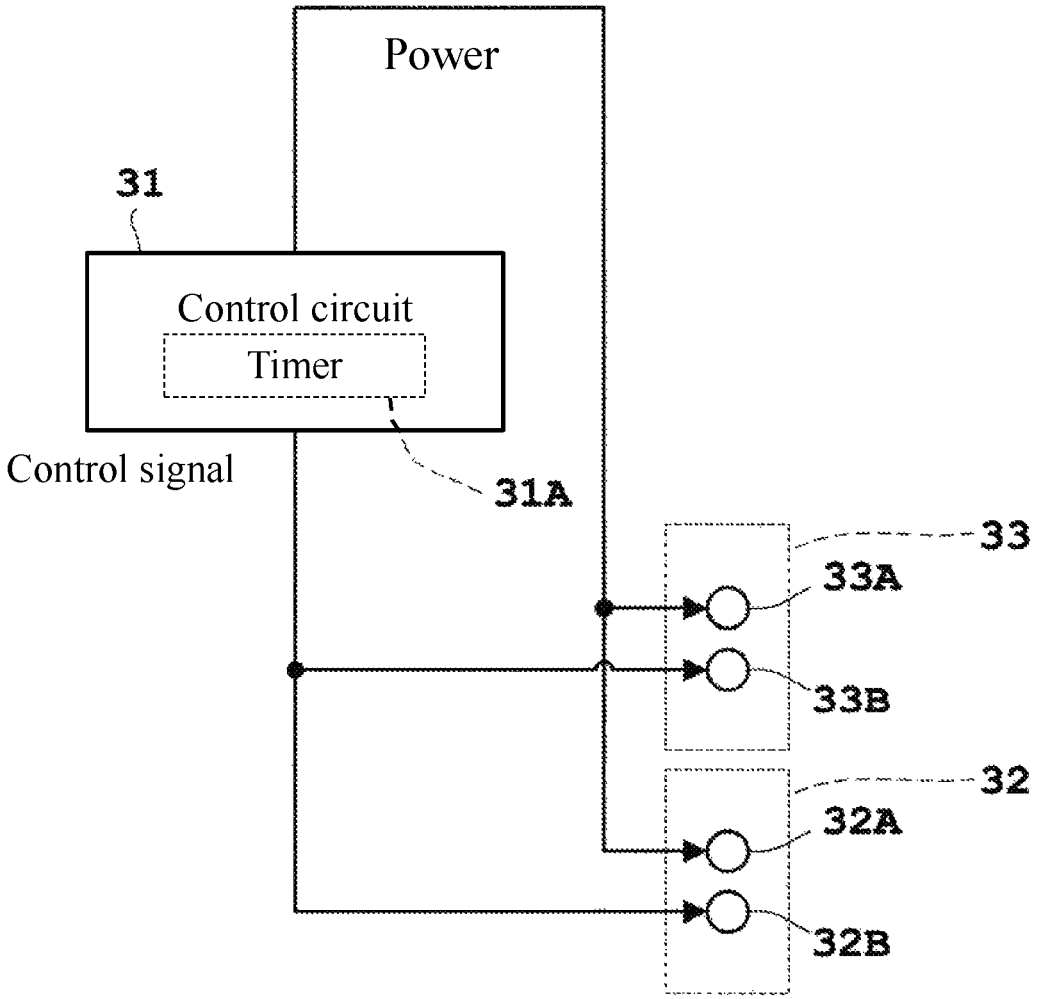
FIG. 4 is a block diagram of a contactor having a power supply terminal and an opening/closing signal terminal and a peripheral control circuit.

The contactors 32 and 33 are configured by electromagnetic contactors. As will be described later, when the timer 31A detects that the nonoperation time has exceeded a preset time, the control circuit 31 controls the contactors 32 and 33 so as to turn off the contactors 32 and 33 into an OFF state. For example, the contactors 32 and 33 each have a structure that can be closed only when predetermined electric power is being supplied, and the control circuit 31 turns off the contactors 32 and 33 by reducing or interrupting the supply of electric power to the contactor 32 and 33. Alternatively, the contactors 32 and 33 may be provided with power supply terminals 32A and 33A and power supply terminals 32B and 33B as shown in FIG. 4 which will be described later. The structure of FIG. 4 will be described later. In this embodiment, as the electromagnetic switch, the contactor 32 and 33 is described as an example. However, the electromagnetic switch is not always limited to a contactor (electromagnetic contactor) as long as it has a function of an electromagnetic switch. For example, an electromagnetic switch (magnet switch) equipped with a thermal relay for overload protection may be used as the electromagnetic switch. In this embodiment, two contactors 32 and 33 are provided as a plurality of contactors for standby power reduction. However, since it is sufficient to reduce at least the standby power of the X-ray tube device 20, for standby power reduction, only the contactor connected to the X-ray tube device 20 may be provided, or three or more contactors may be provided.

The constituent element 34 is, for example, a central processing unit (CPU). The constituent element 35 is, for example, the X-ray tube device 20 or a drive mechanism and a braking mechanism (brake) of the support post 40 (see FIG. 1) and the cassette 60 (see FIG. 1). In this embodiment, two constituent elements 34 and 35 are provided as constituent elements other than the constituent elements (e.g., the inverter 36 and the high voltage transformer 37) related to the X-ray tube 21 (see FIG. 1). However, depending on the configuration of various X-ray devices, only one constituent element may be provided, or three or more constituent elements may be provided.

Figure 3:
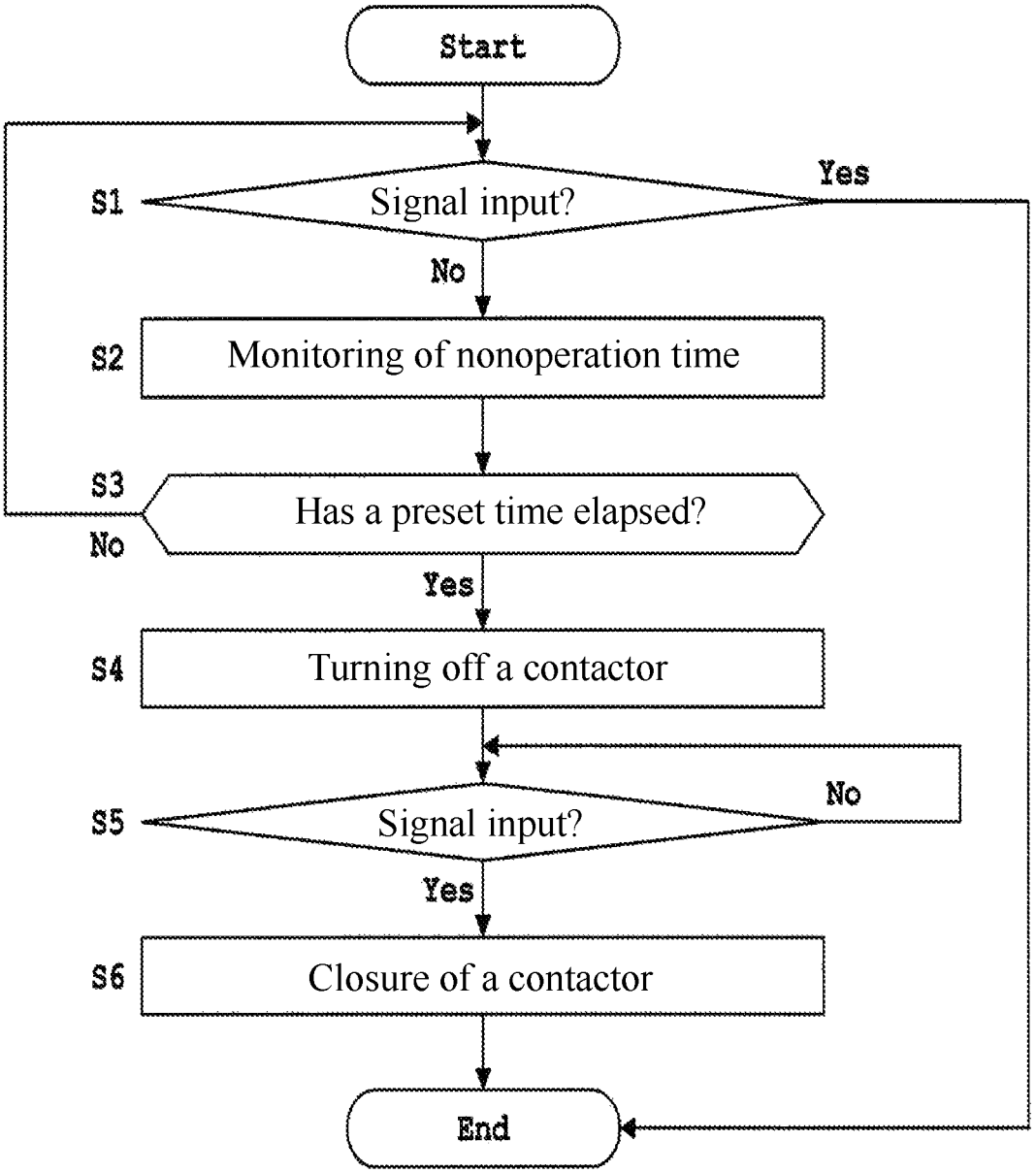
FIG. 3 is a timing chart concerning a control of power supply of the X-ray device.

Next, a control of the power supply to the X-ray device, including a monitor of a nonoperation time, a judgment to a standby mode, a function of standby power reduction, and restoration of power supply, will be described with reference to FIG. 3. FIG. 3 is a timing chart on the control of the power supply to the X-ray device. In FIG. 3, the start time point (described as "Start" in FIG. 3) is in a state in which the previous signal is input to the control circuit 31 (see FIG. 2). The process proceeds from the state in which the contactors 32 and 33 (see FIG. 2) are closed or in an ON state.

(Step S1) has a Signal been Input?

The control circuit 31 judges whether or not the next input signal has been input to the control circuit 31. When the next signal is input to the control circuit 31, the method of FIG. 3 is terminated. When the next signal has not been input to the control circuit 31, the process proceeds to the next Step S2.

As a signal to be input to the control circuit 31, for example, a signal related to radiation conditions (a tube voltage and/or a tube current of the X-ray tube, an irradiation time of the X-ray, etc.) from an external computer or an image processing apparatus (flat panel type X-ray detector: in the case of using an FPD, a digital radiography apparatus (digital X-ray imaging device)), and an operation signal from the operation unit 70 (see FIGS. 1 and 2), etc., can be exemplified. In addition, as the signal, a control signal from a constituent element 34 (see FIG. 2) configured by a CPU and an operation signal from a constituent element 35 (see FIG. 2) configured by a driving mechanism and a braking mechanism can be exemplified.

(Step S2) Monitoring of Nonoperation Time

The time from the previous signal input to the control circuit 31 to the next input signal is referred to as "nonoperation time". The timer 31A (see FIG. 2) of the control circuit 31 monitors (measures) this nonoperation time.

(Step S3) has a Set Time Elapsed?

In the standby power reduction function, a set time (threshold) for the standby power reduction is preset by the operation unit 70. The set time (threshold) is not particularly limited, and may be set such that, for example, a user can select 15 minutes, 30 minutes, and so on. In Step S2, the control circuit 31 judges whether or not the monitored (measured) nonoperation time has elapsed the time preset by the operation unit 70. If the set time has not elapsed, the process returns to Step S1. In Step S1, the control circuit 31 judges whether or not the next input signal has been input to the control circuit 31. When the preset time has elapsed, it is judged that the X-ray device should be set to the standby mode, and the process proceeds to Step S4.

(Step S4) Turning Off a Contactor

When the timer 31A has detected in Step S3 that the nonoperation time has exceeded the preset time, the control circuit 31 controls the contactors 32 and 33 so that the contactors 32 and 33 are turned OFF, respectively.

As shown in FIG. 4, the contactors 32 and 33 are provided with power supply terminals 32A and 33A for supplying electric power and opening/closing signal terminals 32B and 33B for controlling the opening and closing. The control circuit 31 transmits a control signal to the opening/closing signal terminals 32B and 33B of the contactors 32 and 33 to turn off the contactors 32 and 33 and to cut off the power supply provided by the power supply terminals 32A and 33A.

With this, power supply to each constituent element (including an inverter and a high voltage transformer) and the X-ray tube device 20 (see FIGS. 1 and 2) of the X-ray generation mechanism 30 (see FIGS. 1 and 2) is cut off. The power supplied to each constituent element may be cut off not only by cutting off power to the power supply terminals 32A and 33A, but also by reducing the power supplied to the power supply terminals 32A and 33A. It is also possible to reduce the power supply to the contactors 32 and 33 as well as to control the opening/closing of the contactors 32 and 33 by transmitting a control signal to the opening/closing signal terminals 32B and 33B.

(Step S5) has a Signal been Input?

In Step S4, in a state in which the contactors 32 and 33 are in an OFF state, the control circuit 31 judges whether or not the next input signal has been input to the control circuit 31. If the next signal has not been input to the control circuit 31, the process returns to Step S4, and waits until the next signal is input to the control circuit 31 by looping Steps S4 and S5 while maintaining the state in which the contactors 32 and 33 are in a turned OFF state. When the next signal is input to the control circuit 31, the process proceeds to the next Step S6. Instead of the absence or presence of an input of a signal, the process may proceed to the next Step S6 in synchronization with an input of a release signal.

As described in Step S1, as a signal to be input to the control circuit 31, for example, a signal related to radiographic conditions from a digital radiographic apparatus (digital X-ray imaging device), an operation signal from the operation unit 70, etc., can be exemplified. In addition, as the signal, a control signal from a CPU, an operation signal from the driving mechanism and the brake mechanism, etc., can be exemplified.

(Step S6) Closure of a Contactor

In Step S5, when the next signal is input to the control circuit 31, power is supplied to the power supply terminals 32A and 33A, and the control circuit 31 controls contactors 32 and 33 to close the contactors 32 and 33 into an ON state by transmitting a control signal to the respective opening/closing signal terminals 32B and 33B of the contactors 32 and 33. By the closing contactor, power supply to each constituent element of the X-ray generation mechanism 30 and the X-ray tube device 20 is restored.

According to the aforementioned X-ray device 1 of the present embodiment, during a nonoperation time (indicating a time from a previous signal input to the control circuit 31 to the next input signal) by a user, since the power supply not only to the X-ray irradiation means (the X-ray tube 21 in this embodiment) but also to the electromagnetic switch (the contactors 32 and 33 in this embodiment) is reduced or interrupted, the standby power in the standby mode can be further reduced.

Particularly, in cases where an X-ray irradiation means is configured by the X-ray tube 21 as in this embodiment, the X-ray tube 21 requires preliminary heating before photographing. Therefore, when it is attempted to resume photographing from a state in which the supply of electric power is suspended, it takes time to perform preliminary heating. In this regard, if the judging means (timer 31A in this embodiment) is configured to judge that it should be set to a standby mode when the aforementioned nonoperation time exceeds the threshold, the operability is not deteriorated during photographing and the standby power when not in use can be appropriately reduced.

As in this embodiment, it may be configured that the electromagnetic switch (contactor 32, 33) has a structure capable of closing only while predetermined electric power is being supplied, and that the control circuit 31 turns off the electromagnetic switches (contactors 32 and 33) by reducing or cutting off the power supply to the electromagnetic switches (contactors 32 and 33).

Alternatively, as shown in FIG. 4, it may be configured such that the electromagnetic switch (contactor 32, 33) has a power supply terminal 32A, 33A for supplying electric power and an opening/closing signal terminal 32B, 33B for supplying an opening/closing signal, the control circuit 31 has a power supply terminal 32A, 33A for supplying electric power and an opening/closing signal terminal 32B, 33B for supplying an opening/closing signal, the control circuit 31 reduces or cuts off the power supply to the electromagnetic switch (contactor 32, 33) by reducing or cutting off the power to the power supply terminal 32A, 33A, and the opening/closing of the electromagnetic switch (contactor 32, 33) is controlled by controlling a signal to the opening/closing signal terminal 32B, 33B.

The present invention is not limited to the aforementioned embodiment, and can be modified as follows.

(1) In the aforementioned embodiment, the X-ray device is used as a medical X-ray device for a subject as a human body, but it may be applied to a nondestructive inspection apparatus for a mounting board, etc. Further, the X-ray device may be applied to an analog radiography apparatus (analog X-ray imaging apparatus) using the aforementioned X-ray film, or a digital radiographic apparatus (digital X-ray imaging device) using the aforementioned flat panel type X-ray detector (FPD). At that time, an image processing apparatus, etc., may be provided for the X-ray device.

(2) In the aforementioned embodiment, the X-ray device has a structure equipped with the X-ray tube device 20 configured to be vertically movable in the vertical direction along the support post 40 as shown in FIG. 1, but the structure of the X-ray device is not limited to the structure shown in FIG. 1. For example, it may be applied to an X-ray device configured to perform photographing or radiographic inspection in a horizontal posture or standing posture, or may also be applied to an X-ray device such as an X-ray tomographic apparatus or an X-ray CT apparatus for acquiring a tomographic image.

(3) In the aforementioned embodiment, the X-ray irradiation means is configured by a tubular X-ray tube, but not limited to an X-ray tube as long as it is configured to irradiate an X-ray. For example, it may be configured such that an X-ray irradiation means of a ring shape surrounding a subject is installed to perform tomographic photographing, or radiographic inspection from a variety of directions.

(4) In the aforementioned embodiment, as shown in FIG. 2, the judging means (the timer 31A in the embodiment) is provided in the control circuit 31. However, the control circuit and the judging means may be provided separately from each other.

(5) The judging means may be configured to detect a standby mode instruction from a user. For example, it may be configured such that a standby mode switch is provided at a display of a console (not illustrated), when the standby mode switch is operated by an operator such as a user, it is judged that it should be set to a standby mode, and when a release switch separately provided is operated, the standby mode is released.

(6) As described above, it may be configured such that as the contactor 32, 33, an element which becomes in an open state in a state in which no power is supplied to the power supply terminal and becomes a closed state when power is supplied thereto. In this case, only by controlling the power supply to the contactors 32 and 33, the opening and closing of the contactors 32 and 33 can be controlled.

DESCRIPTION OF REFERENCE SYMBOLS

1 . . . X-ray device
21 . . . X-ray tube
31 . . . control circuit
31A . . . timer
32, 33 . . . contactor
32A, 33A . . . power supply terminal
32B, 33B . . . opening/closing signal terminal
50 . . . power cable

The invention claimed is:

1. An X-ray device provided with an X-ray irradiator for irradiating X-rays, comprising:

an electromagnetic switch configured to open/close to respectively electrically disconnect/connect power supply line to the X-ray irradiator;

a control circuit connected to the electromagnetic switch and configured to control a power of the power supply line provided to the electromagnetic switch and to control the opening/closing of the electromagnetic switch; and judging means configured to judge whether or not the X-ray irradiator should be set to a standby mode, wherein the control circuit is configured to reduce or cut off the power of the power supply line provided to the electromagnetic switch and to release the electromagnetic switch in response to the judging means judging that the X-ray irradiator should be set to the standby mode.

2. The X-ray device as recited in claim 1, wherein the judging means judges that the X-ray irradiator should be set to the standby mode when a nonoperation time by an operator exceeds a threshold value.

3. The X-ray device as recited in claim 1, wherein the electromagnetic switch has a structure capable of being in a closed state only while a predetermined amount of electric power is being supplied, and wherein the control circuit releases the electromagnetic switch by reducing or cutting off the power provided to the electromagnetic switch to turn off the electromagnetic switch.

4. The X-ray device as recited in claim 1, wherein the electromagnetic switch includes a power supply terminal configured to supply electric power and a signal terminal and to control the opening/closing of the electromagnetic switch in response to a control signal, and wherein the control circuit is configured to reduce or cut off the power provided to the electromagnetic switch by reducing or cutting off power supplied to the power supply terminal, and to control the opening/closing of the electromagnetic switch by providing the control signal to the signal terminal.

5. A method of operating an X-ray device, comprising:

determining that an X-ray irradiator of the X-ray device should be put into a standby mode;

in response to determining that the X-ray irradiator should be put into the standby mode, interrupting a power supplied to the X-ray irradiator by electrically disconnecting a power supply line electrically connected to the X-ray irradiator with an electromagnetic switch, wherein the electromagnetic switch disconnects the power supply line in response to a power being supplied to the electromagnetic switch being reduced or being cut off.

6. The method of claim 5, further comprising:

monitoring a time period after the most recent operation of an operator, wherein determining that the X-ray irradiator should be put into the standby mode comprises determining that the monitored time period exceeds a predetermined value.

7. A method of operating an X-ray device, comprising:

determining that an X-ray irradiator of the X-ray device should be put into a standby mode;

in response to determining that the X-ray irradiator should be put into the standby mode, sending a control signal to an electromagnetic switch; and in response to the control signal, interrupting a power supplied to the X-ray irradiator through the electromagnetic switch by electrically disconnecting a power supply line electrically connected to the X-ray irradiator with the electromagnetic switch.

8. The method of claim 7, further comprising:

monitoring a time period after the most recent operation of an operator, wherein determining that the X-ray irradiator should be put into the standby mode comprises determining that the monitored time period exceeds a predetermined value.

* * * * *